US009849891B2

(12) United States Patent
Kawakami et al.

(10) Patent No.: US 9,849,891 B2
(45) Date of Patent: Dec. 26, 2017

(54) RAILCAR AND DOOR POCKET POST

(71) Applicant: KAWASAKI JUKOGYO KABUSHIKI KAISHA, Kobe-shi, Hyogo (JP)

(72) Inventors: Naoaki Kawakami, Kobe (JP); Shinichi Okada, Kobe (JP); Naohiro Yoshida, Kobe (JP); Kazumasa Inaba, Kobe (JP); Kenji Waki, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 489 days.

(21) Appl. No.: 14/408,170

(22) PCT Filed: Jun. 11, 2013

(86) PCT No.: PCT/JP2013/003668
§ 371 (c)(1),
(2) Date: Dec. 15, 2014

(87) PCT Pub. No.: WO2013/187051
PCT Pub. Date: Dec. 19, 2013

(65) Prior Publication Data

US 2015/0135987 A1 May 21, 2015

(30) Foreign Application Priority Data

Jun. 13, 2012 (JP) ..... 2012-133783

(51) Int. Cl.
*B61D 17/00* (2006.01)
*B61D 17/08* (2006.01)
(Continued)

(52) U.S. Cl.
CPC ..... *B61D 17/00* (2013.01); *B61D 17/08* (2013.01); *B61D 19/00* (2013.01); *B61D 19/02* (2013.01)

(58) Field of Classification Search
CPC ..... B61D 17/00; B61D 17/08; B61D 19/00; B61D 19/007; B61D 19/02
See application file for complete search history.

(56) References Cited

U.S. PATENT DOCUMENTS 5,333,554 A * 8/1994 Yamada ..... B61D 17/043 105/397
6,302,031 B1 * 10/2001 Smith ..... B61D 7/02 105/355
(Continued)

FOREIGN PATENT DOCUMENTS

CN 2012-14417 Y 4/2009
JP U-3041523 9/1997
(Continued)

OTHER PUBLICATIONS

International Search Report issued in PCT/JP2013/003668 dated Sep. 17, 2013.
(Continued)

*Primary Examiner* — Jason C Smith
(74) *Attorney, Agent, or Firm* — Oliff PLC

(57) ABSTRACT

A railcar includes a side sliding door and entrance peripheral-member surrounding the side entrance. The entrance peripheral-member includes a door pocket post in which outer and inner portions are inwardly of the outer portion in car-width direction coupled to each other. The side sliding door peripheral portion is pressed against an edge portion, extending along the side entrance of the entrance peripheral-member via a rubber seal at the side entrance closed state. In the side entrance open state, the side sliding door is pulled into a door pocket space facing the door pocket post inner portion. A portion projecting inwardly in car-width direction beyond the inner portion and including a tip end contacting the rubber seal provided at at least part of region constituted by portions of upper and lower edges of the side entrance
(Continued)

peripheral-member and lateral edge at the edge portion door pocket post side of the entrance peripheral-member.

12 Claims, 5 Drawing Sheets

(51) Int. Cl.
*B61D 19/00* (2006.01)
*B61D 19/02* (2006.01)

(56) References Cited

U.S. PATENT DOCUMENTS

| | | | | |
|---|---|---|---|---|
| 7,210,413 | B2 * | 5/2007 | Barry | B60P 3/20 105/355 |
| 2007/0214998 | A1 * | 9/2007 | Komaki | B23K 26/22 105/396 |
| 2007/0284913 | A1 * | 12/2007 | Ehrlich | B62D 33/046 296/186.1 |
| 2010/0089283 | A1 * | 4/2010 | Kono | B23K 33/00 105/397 |
| 2010/0132589 | A1 * | 6/2010 | Harada | B23K 9/0026 105/397 |
| 2012/0125225 | A1 * | 5/2012 | Matsuoka | B61D 15/06 105/396 |
| 2013/0319282 | A1 * | 12/2013 | Mitani | B61D 17/12 105/397 |
| 2015/0135987 | A1 * | 5/2015 | Kawakami | B61D 17/08 105/397 |

FOREIGN PATENT DOCUMENTS

| | | |
|---|---|---|
| JP | A-2000-344096 | 12/2000 |
| JP | 2001-58568 | 3/2001 |
| JP | A-2004-66883 | 3/2004 |
| JP | A-2010-23696 | 2/2010 |
| JP | 2011-126360 A | 6/2011 |

OTHER PUBLICATIONS

Jan. 29, 2016 Translation of Office Action issued in Chinese Patent Application No. 201380026077.X.

* cited by examiner

RAILCAR AND DOOR POCKET POST

TECHNICAL FIELD

The present invention relates to a railcar and particularly to structures around a side entrance.

BACKGROUND ART

Conventionally, according to a railcar, such as the shinkansen (trademark), which travels at high speed, in order to obtain excellent comfortability in the railcar, a side sliding door that opens or closes a side entrance adopts an airtight structure to suppress pressure variation inside the railcar. For example, as shown in FIG. 5, PTL 1 discloses a railcar 100 configured such that both end portions of a side sliding door 120 are respectively pressed, via rubber seals 150, against a door pocket post 130 and a door stop post 140 respectively provided at both sides of a side entrance 110.

To secure the airtightness, the door pocket post 130 has to have relatively high stiffness. The door pocket post 130 has a double skin structure that is flat in a car-longitudinal direction. Specifically, the door pocket post 130 is configured such that an outer portion 131 and an inner portion 132 are coupled to each other by coupling portions 133. According to the railcar 100 disclosed in PTL 1, an edge portion 135, extending along the side entrance 110, of the door pocket post 130 is located outwardly of the inner portion 132 in a car-width direction, and a rubber seal 150 is attached to the edge portion 135.

CITATION LIST

Patent Literature

PTL 1: Japanese Laid-Open Patent Application Publication No. 2001-58568

SUMMARY OF INVENTION

Technical Problem

In the case of using the door pocket post 130 having the double skin structure, because of the thickness of the door pocket post 130, the inner portion 132 gets close to the side sliding door 120 when the side sliding door 120 is pulled into a door pocket space adjacent to the inner portion 132. To satisfactorily perform the operation of pulling the side sliding door 120 into the door pocket space, a certain clearance needs to be secured between the side sliding door 120 and a bodyshell (the door pocket post 130) over the entire surface of the inner portion 132. Therefore, in a case where the clearance between the side sliding door 120 and the door pocket post 130 is narrow, the clearance needs to be increased.

Normally, the side sliding door 120 and the bodyshell including the door pocket post 130 are separately manufactured. Therefore, the above operation of adjusting the clearance is performed in a step of incorporating the side sliding door 120 in the bodyshell after the bodyshell is manufactured. For example, the operation of adjusting the clearance for satisfactorily pulling the side sliding door into the door pocket space is performed in such a manner that the clearance between the door pocket post 130 and the side sliding door 120 is increased to become equal to or larger than a certain value over the entire surface of the inner portion 132 by, for example, heating an area, including the door pocket post 130, of the bodyshell while pressing the door pocket post 130 by a hydraulic jack or the like.

In addition to the above adjusting operation, in order to secure the airtightness, it is also necessary to adjust the clearance between the side sliding door and the bodyshell before the side sliding door 120 is pressed against the edge portion 135 at the time of a door closed state (hereinafter may be referred to as "at the time of a closed state"). To be specific, the side sliding door 120 and the bodyshell require both the operation of adjusting the clearance for satisfactorily pulling the side sliding door 120 into the door pocket space and the operation of adjusting the clearance for securing the airtightness at the time of the door closed state.

A problem of the conventional railcar is that it requires a lot of labor and time to adjust the clearance between the side sliding door and the bodyshell as above.

Here, an object of the present invention is to provide a railcar capable of reducing an operation of adjusting a clearance between a side sliding door and a bodyshell, and a door pocket post suitable for this railcar.

Solution to Problem

To solve the above problem, a railcar of the present invention includes: a side entrance peripheral member including a door pocket post and surrounding a side entrance, the door pocket post having a double skin structure in which an outer portion and an inner portion are coupled to each other by a coupling portion, the inner portion being provided inwardly of the outer portion in a car-width direction; and a side sliding door including a peripheral portion that is pressed against an edge portion, extending along the side entrance, of the side entrance peripheral member via a rubber seal at the time of a closed state of the side entrance, the side sliding door being pulled into a door pocket space, adjacent to the inner portion of the door pocket post, at the time of an open state of the side entrance, wherein a projecting portion projecting inwardly in the car-width direction beyond the inner portion and including a tip end that contacts the rubber seal is provided at at least a part of a region constituted by an upper edge and lower edge of the edge portion of the side entrance peripheral member and a lateral edge, located at the door pocket post side, of the edge portion of the side entrance peripheral member.

According to the above configuration, the projecting portion that contacts the rubber seal is provided at the edge portion of the side entrance peripheral member. Therefore, the clearance (clearance for satisfactorily pulling the side sliding door into the door pocket space) between the inner portion of the door pocket post and the side sliding door becomes larger than the clearance (clearance for securing the airtightness) between the projecting portion and the side sliding door. On this account, the operation of adjusting the clearance is required only at a narrow range corresponding to the projecting portion. Thus, the operation of adjusting the clearance between the side sliding door and the bodyshell can be reduced.

A door pocket post of the present invention is a door pocket post provided at one side of a side entrance of a railcar and includes: an outer portion; an inner portion provided inwardly of the outer portion in a car-width direction; a coupling portion coupling the outer portion and the inner portion; a vertical bar portion where an end portion, located at the side entrance side, of the outer portion and an end portion, located at the side entrance side, of the inner portion converge; and a projecting portion provided at the vertical bar portion and projecting inwardly in the car-width direction beyond the inner portion.

Advantageous Effects of Invention

The present invention can provide a railcar capable of reducing an operation of adjusting a clearance between a side sliding door and a bodyshell, and a door pocket post suitable for this railcar.

DESCRIPTION OF EMBODIMENTS

Hereinafter, an embodiment of the present invention will be explained in reference to the drawings.

Figure 1:
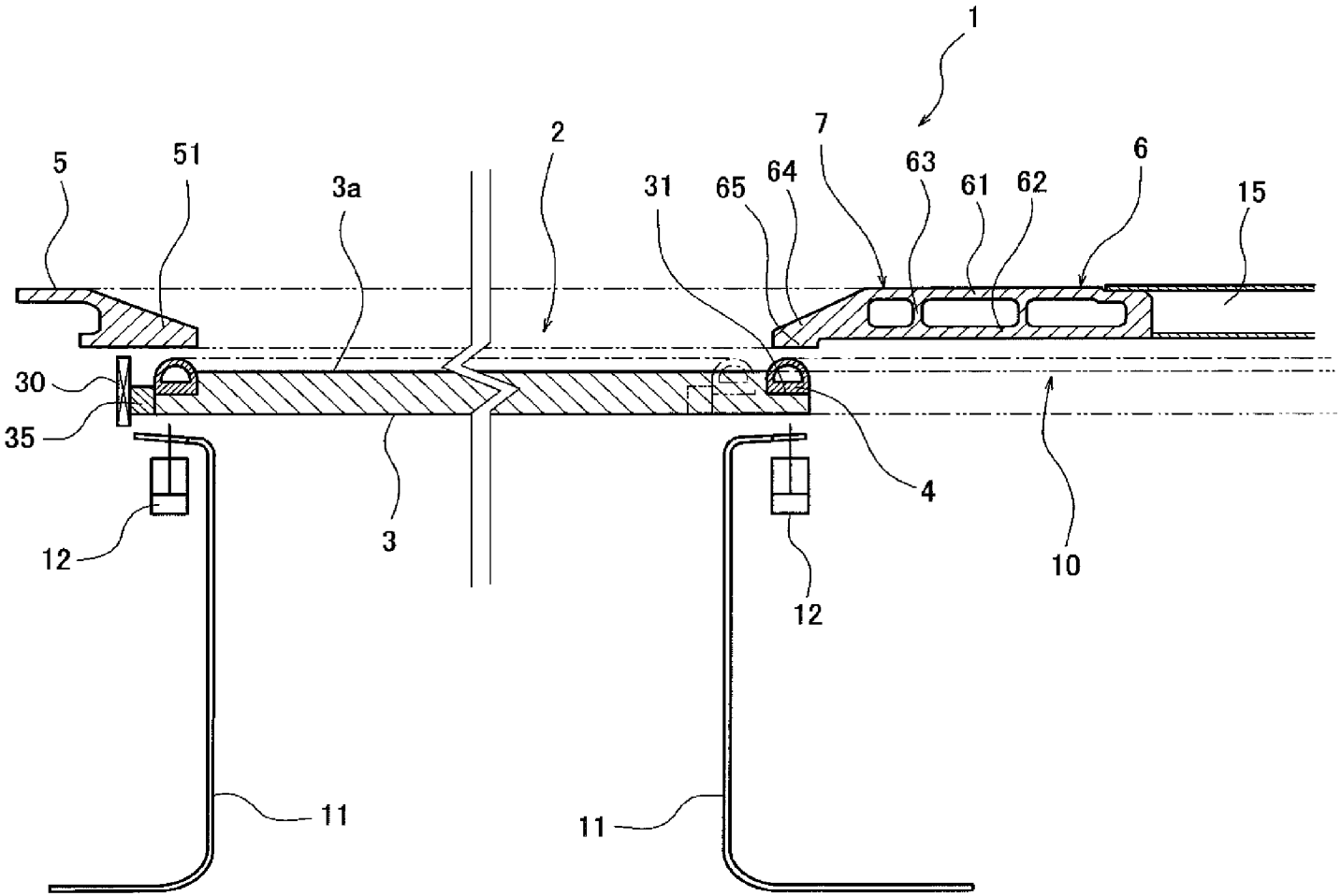
FIG. 1 is a cross-sectional view of structures around a side entrance of a railcar according to one embodiment of the present invention.

FIG. 1 shows a railcar 1 according to one embodiment of the present invention. The railcar 1 includes: a side entrance peripheral member 7 surrounding a side entrance 2; and a side sliding door 3 configured to open and close the side entrance 2. In FIG. 1, a left-right direction corresponds to a car-longitudinal direction, and an upper-lower direction corresponds to a car-width direction.

Figure 2B:
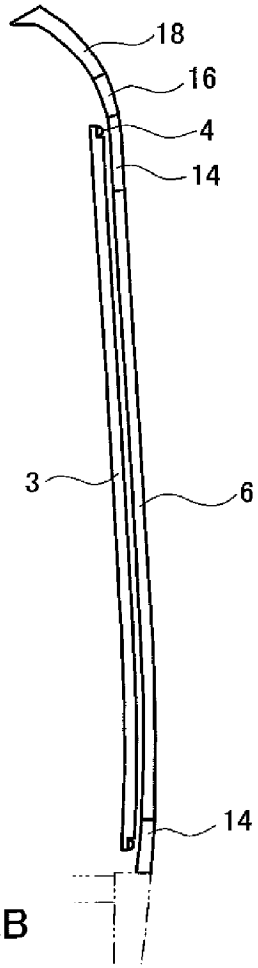
FIG. 2B is a cross-sectional view taken along line IIB-IIB of FIG. 2A.
Figure 2A:
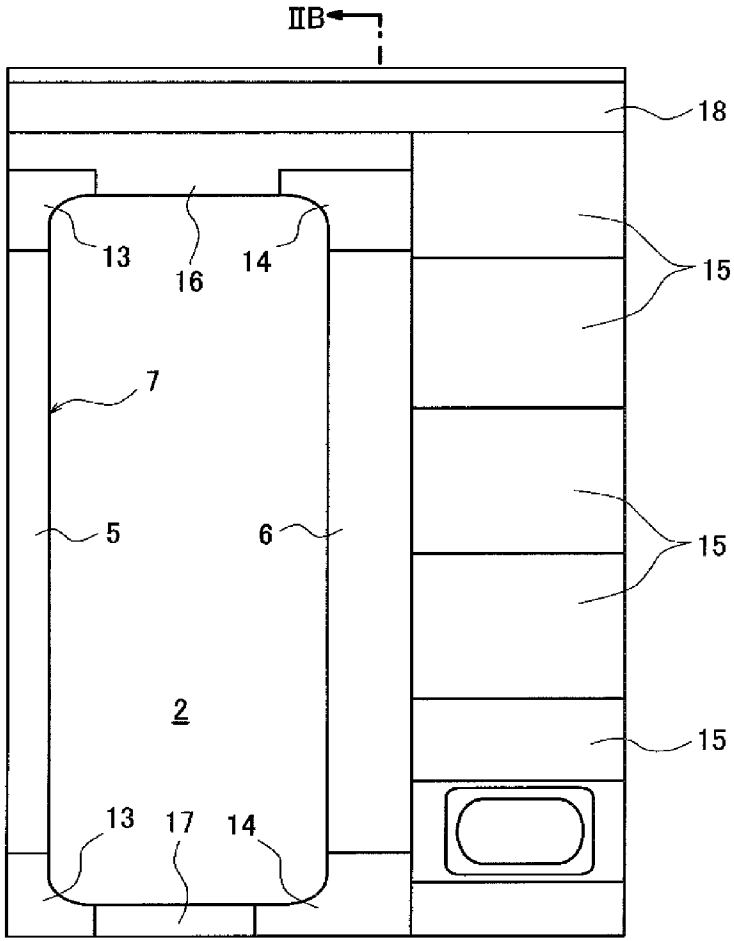
FIG. 2A is a diagram showing a bodyshell around the side entrance, when viewed from an inner side in a car-width direction.

As shown in FIG. 2A, the side entrance 2 has a vertically long, substantially rectangular shape. The side entrance peripheral member 7 includes a frame-shaped edge portion extending along the side entrance 2. Specifically, the side entrance peripheral member 7 includes: a door stop post 5 and a door pocket post 6 respectively provided at left and right sides of the side entrance 2; a lintel member 16 provided at an upper side of the side entrance 2; and a doorsill member 17 provided at a lower side of the side entrance 2. Further, the side entrance peripheral member 7 includes: fixed side corner members 13 respectively provided between the door stop post 5 and the lintel member 16 and between the door stop post 5 and the doorsill member 17; and movable side corner members 14 respectively provided between the door pocket post 6 and the lintel member 16 and between the door pocket post 6 and the doorsill member 17. The corner members 13 and 14 respectively form four quarter-circular corners of the side entrance 2.

However, the configuration of the side entrance peripheral member 7 is not limited to the configuration shown in FIG. 2A. For example, instead of providing the movable side corner member 14 located at the lower side, the door pocket post 6 may be joined to a side sill constituting an underframe. Or, instead of providing the movable side corner member 14 located at the upper side, the door pocket post 6 may be joined to the lintel member 16 or a cantrail 18.

As shown in FIG. 2B, each of the door pocket post 6 and the door stop post 5 extends in the upper-lower direction while slightly curving along the contours of the railcar 1 in the car-width direction. The door pocket post 6 and the door stop post 5 are members formed by extrusion and are provided such that an extrusion direction corresponds to its longitudinal direction.

A plurality of shape members 15 each extending in the car-longitudinal direction are lined up in the upper-lower direction so as to be located at a side of the door pocket post 6, the side being opposite to a side where the side entrance 2 is provided. The shape members 15 and the door pocket post 6 are joined to one another by welding. The door pocket post 6 and the shape members 15 covers, from an outer side in the car-width direction, a door pocket space 10 (see FIG. 1) into which the side sliding door 3 is pulled.

Referring again to FIG. 1, a pair of covers 11 that form a passage extending from a car-inner space to the side entrance 2 are provided inwardly of the side sliding door 3 in the car-width direction. Each of the covers 11 has a substantially U-shaped cross section, and the U shapes of the covers 11 are open in directions opposite to each other. The cover 11 located at the door pocket post 6 side separates the door pocket space 10 from the car-inner space and the passage, and a stopper 30 is provided between the cover 11 located at the door stop post 5 side and the door stop post 5 such that the side sliding door 3 contacts the stopper 30 to stop.

The door pocket post 6 and the door stop post 5 respectively include vertical bar portions 64 and 51 extending along the side entrance 2. Each of outer surfaces of the vertical bar portions 64 and 51 inclines inwardly in the car-width direction as it gets close to the side entrance 2. Each of the vertical bar portions 64 and 51 tapers toward the side entrance 2. The vertical bar portion 64 of the door pocket post 6 and portions of the movable side corner members 14 constitute one of lateral edges of the edge portion of the side entrance peripheral member 7, each of the portions being located at the door pocket post 6 side of an intermediate point of a circular-arc portion of the movable side corner member 14. The vertical bar portion 51 of the door stop post 5 and portions of the fixed side corner members 13 constitute the other lateral edge of the edge portion of the side entrance peripheral member 7, each of the portions being located at the door stop post 5 side of the intermediate point of the circular-arc portion of the fixed side corner member 13. A lower portion of the lintel member 16, a portion of the corner member 13 located at the upper side, and a portion of the corner member 14 located at the upper side constitute an upper edge of the edge portion of the side entrance peripheral member 7, the portion of the corner member 13 being located at the lintel member 16 side of the intermediate point of the circular-arc portion of the corner member 13, the portion of the corner member 14 being located at the lintel member 16 side of the intermediate point of the circular-arc portion of the corner member 14. An upper portion of the doorsill member 17, a portion of the corner member 13 located at the lower side, and a portion of the corner member 14 located at the lower side constitute a lower edge of the edge portion of the side entrance peripheral member 7, the portion of the corner member 13 being located at the doorsill member 17 side of the intermediate point of the circular-arc portion of the corner member 13, the portion of the corner member 14 being located at the doorsill member 17 side of the intermediate point of the circular-arc portion of the corner member 14.

The side sliding door 3 has a vertically long, rectangular shape slightly larger than the side entrance 2. The side sliding door 3 is moved by a driving unit, not shown, along the car-longitudinal direction between a closed position where both width direction end portions of the side sliding door 3 respectively overlap the vertical bar portion 64 of the door pocket post 6 and the edge portion 51 of the door stop post 5 and an open position where the side sliding door 3 is opposed to the door pocket post 6 and the shape members 15. To be specific, when the side sliding door 3 is moved to the closed position, it closes the side entrance 2, and when the side sliding door 3 is moved to the open position, it is pulled into the door pocket space 10 to open the side entrance 2. A contact member 35 configured to contact the stopper 30 when the side sliding door 3 is moved to the closed position is attached to an end surface of the side sliding door 3, the end surface being located at the door stop post 5 side.

In the present embodiment, an annular rubber seal 4 along a peripheral portion of the side sliding door 3 is attached to the peripheral portion. Specifically, a step portion 31 is formed at the peripheral portion of the side sliding door 3. The step portion 31 is depressed inwardly in the car-width direction from a main surface 3*a*, facing outwardly in the car-width direction, of the side sliding door 3. The rubber seal 4 is fixed to the step portion 31.

Cylinders 12 are respectively provided in spaces respectively surrounded by the covers 11. At the time of the closed state of the side entrance 2, the cylinders 12 are used for the purpose of pressing the peripheral portion of the side sliding door 3 via the rubber seal 4 against the edge portion, extending along the side entrance 2, of the side entrance peripheral member 7. The cylinders 12 may be provided such that rods thereof extend and contract in the car-width direction to allow the cylinders 12 to directly push both width direction end portions of the side sliding door 3 or such that the rods thereof extend and contract in the upper-lower direction to allow the cylinders 12 to push both end portions of the side sliding door 3 via link mechanisms.

It should be noted that the peripheral portion of the side sliding door 3 does not necessarily have to be pressed against the edge portion of the side entrance peripheral member 7 via the rubber seal 4 over the entire periphery. For example, the rubber seal 4 may have an inverted U shape that is open downward, and the peripheral portion of the side sliding door 3 may be pressed against the lateral edges and upper edge of the edge portion of the side entrance 7.

Figure 3:
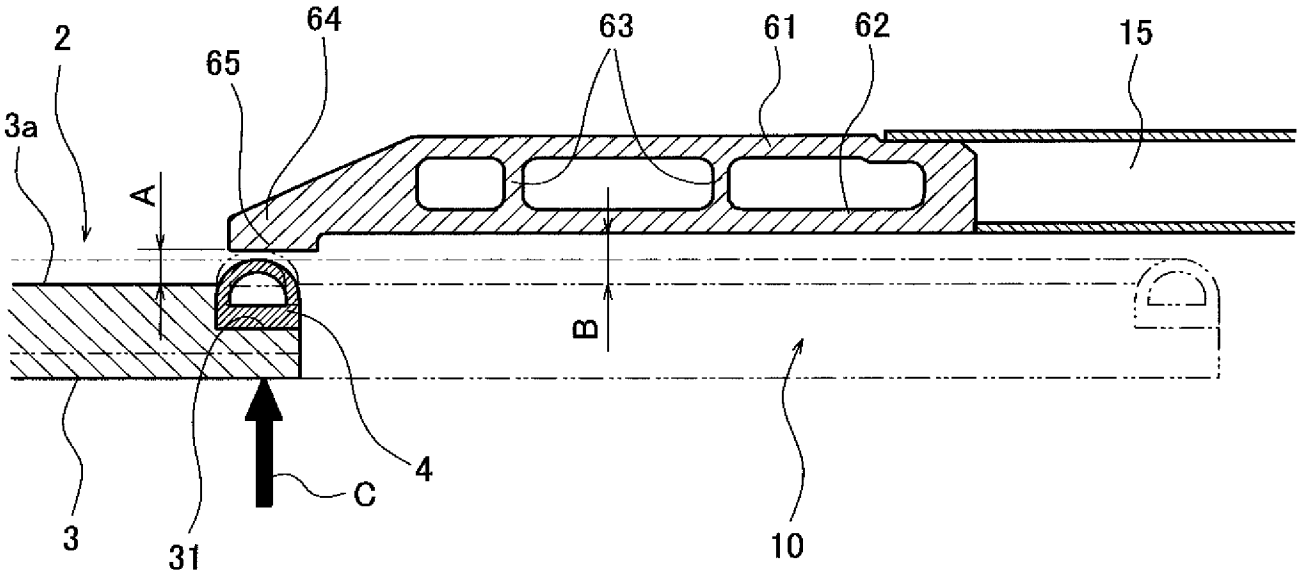
FIG. 3 is an enlarged view of major components of FIG. 1.

Next, the configuration of the door pocket post 6 will be explained in more detail in reference to FIG. 3.

The door pocket post 6 has a double skin structure that is flat in the car-longitudinal direction. Specifically, the door pocket post 6 includes: an outer portion 61 facing outwardly in the width direction; and an inner portion 62 provided inwardly of the outer portion 61 in the car-width direction. The outer portion 61 and the inner portion 62 are coupled to each other by a plurality of coupling portions 63. In other words, voids are secured between the outer portion 61 and the inner portion 62 by the coupling portions 63.

Figure 4:
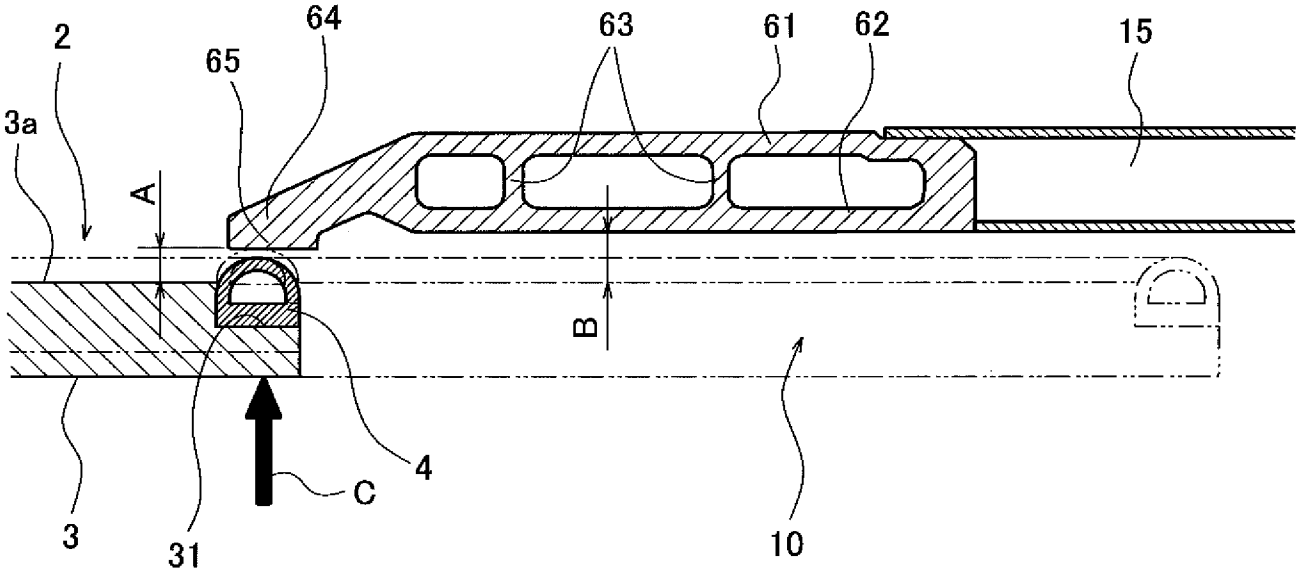
FIG. 4 is a cross-sectional view of a door pocket post of Modification Example.
Figure 5:
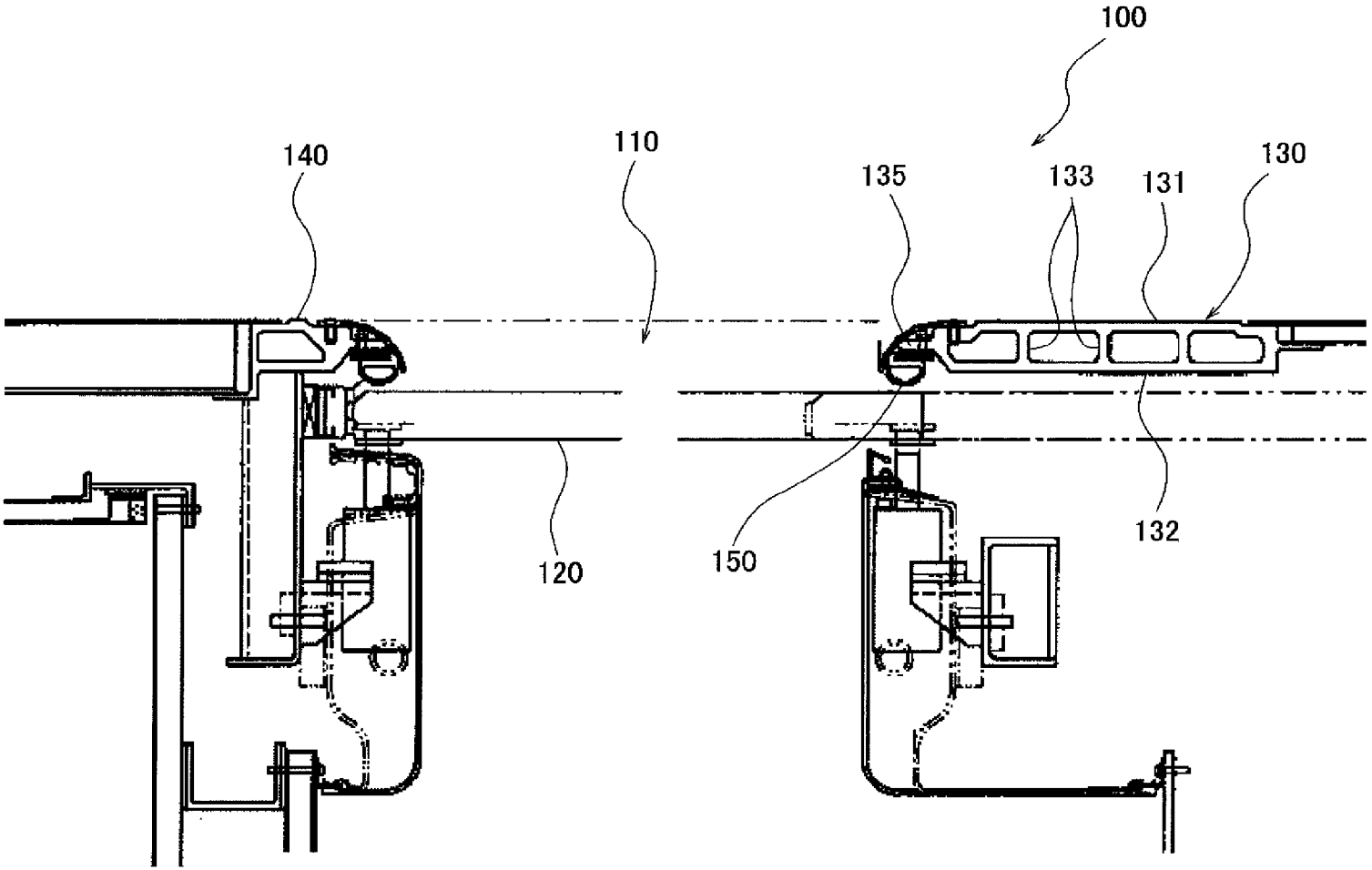
FIG. 5 is a cross-sectional view showing the structures around the side entrance of the conventional railcar.

The inner portion 62 is linearly connected to the vertical bar portion 64. In contrast, an end portion, located at the side entrance 2 side, of the outer portion 61 is bent inwardly in the car-width direction so as to form an inclined surface that is continuous with the outer surface of the vertical bar portion 64. In other words, the vertical bar portion 64 is a portion where an end portion, located at the side entrance 2 side, of the inner portion 62 and the end portion, located at the side entrance 2 side, of the outer portion 61 converge. It should be noted that the inner portion 62 does not necessarily have to be linear over the entire width. For example, as shown in FIG. 4, the end portion, located at the side entrance 2 side, of the inner portion 62 may be bent outwardly in the car-width direction.

A projecting portion 65 projecting inwardly in the car-width direction beyond the inner portion 62 is provided at a region of the vertical bar portion 64, the region corresponding to the rubber seal 4 when the side sliding door 3 is moved to the closed position. To be specific, when the side sliding door 3 is pushed by the cylinder 12 (see FIG. 1) as shown by an arrow C in FIG. 3, a tip end of the projecting portion 65 contacts the rubber seal 4.

A clearance A between the side sliding door 3 and the projecting portion 65 of the door pocket post 6 before the peripheral portion of the side sliding door 3 is pressed against the edge portion of the side entrance peripheral member 7 at the time of the closed state of the side entrance 2 is smaller than a clearance B between the side sliding door 3 and the inner portion 62 of the door pocket post 6 at the time of the open state of the side entrance 2. In other words, the clearance B for satisfactorily pulling the side sliding door 3 into the door pocket space is larger than the clearance A for securing the airtightness.

According to conventional structures, when adjusting the clearance between the side sliding door 3 and the side entrance peripheral member 7, the value of the clearance A and the value of the clearance B are substantially equal to each other. Therefore, the adjustment of the clearance needs to be performed over a wide range of the inner portion 62 of the door pocket post 6. On this account, this operation requires a lot of labor and time. However, according to the railcar 1 of the present embodiment, the operation of adjusting the clearance is required only at a narrow range corresponding to the projecting portion 65 (for example, an operation of cutting the projecting portion 65). Therefore, the operation of adjusting the clearance between the side sliding door 3 and the bodyshell can be reduced.

The rubber seal 4 may be attached to the edge portion of the side entrance peripheral member 7. However, in this case, the large cover 11 shown in FIG. 1 and the like need to be detached at the time of the replacement of the rubber seal 4. Therefore, this replacement operation requires a lot of labor. In contrast, in a case where the rubber seal 4 is attached to the peripheral portion of the side sliding door 3 as in the present embodiment, the rubber seal 4 can be replaced only by, for example, detaching the contact member 35 (see FIG. 1) and moving the side sliding door 3. To be specific, according to the railcar of the present embodiment, the ease of maintenance can be improved.

Further, according to the present embodiment, the step portion 31 to which the rubber seal 4 is fixed is formed at the peripheral portion of the side sliding door 3. Therefore, at the time of the closed state of the side entrance 2, the rubber seal 4 is not exposed so much from between the vertical bar portion 64 of the door pocket post 6 and the side sliding door 3. In contrast, in a case where the step portion 31 is not formed, the rubber seal 4 is largely exposed from between the vertical bar portion 64 of the door pocket post 6 and the side sliding door 3, so that a cover for the rubber seal 4 is required. To be specific, in a case where the step portion 31 is formed as in the present embodiment, the number of parts can be reduced.

According to the present embodiment, the projecting portion 65 projecting inwardly in the car-width direction beyond the inner portion 62 is provided at the door pocket post 6. However, the present invention is not limited to this. The projecting portion 65 may be provided at a component (the lintel member 16, the doorsill member 17, or the corner member 13 or 14) other than the door pocket post 6 of the side entrance peripheral member 7. To be specific, the projecting portion 65 is only required to be provided at at least a part of a substantially U-shaped region constituted by an upper edge and lower edge of the edge portion, extending along the side entrance 2, of the side entrance peripheral member 7 and a lateral edge, located at the door pocket post 6 side, of the edge portion of the side entrance peripheral member 7. It should be noted that in a case where the projecting portion 65 is provided at the vertical bar portion 64 of the door pocket post 6 as in the present embodiment, satisfactory airtightness can be obtained as compared to a case where the projecting portion 65 is provided at the lintel member 16 or the doorsill member 17. The projecting portion 65 as a separate member may constitute the side entrance peripheral member 7 instead of being integrated with the door pocket post 6 and the like.

Outline

The above-described railcar includes: a side entrance peripheral member including a door pocket post and surrounding a side entrance, the door pocket post having a double skin structure in which an outer portion and an inner portion are coupled to each other by a coupling portion, the inner portion being provided inwardly of the outer portion in a car-width direction; and a side sliding door including a peripheral portion that is pressed against an edge portion, extending along the side entrance, of the side entrance peripheral member via a rubber seal at the time of a closed state of the side entrance, the side sliding door being pulled into a door pocket space, adjacent to the inner portion of the door pocket post, at the time of an open state of the side entrance, wherein a projecting portion projecting inwardly in the car-width direction beyond the inner portion and including a tip end that contacts the rubber seal is provided at at least a part of a region constituted by an upper edge and lower edge of the edge portion of the side entrance peripheral member and a lateral edge, located at the door pocket post side, of the edge portion of the side entrance peripheral member.

According to this configuration, the projecting portion that contacts the rubber seal is provided at the edge portion of the side entrance peripheral member. Therefore, the clearance (clearance for satisfactorily pulling the side sliding door into the door pocket space) between the inner portion of the door pocket post and the side sliding door becomes larger than the clearance (clearance for securing the airtightness) between the projecting portion and the side sliding door. On this account, the operation of adjusting the clearance is required only at the narrow range corresponding to the projecting portion. Thus, the operation of adjusting the clearance between the side sliding door and the bodyshell can be reduced.

According to the above-described railcar, a clearance between the side sliding door and the projecting portion before the peripheral portion of the side sliding door is pressed against the edge portion at the time of the closed state of the side entrance is smaller than a clearance between the side sliding door and the inner portion of the door pocket post at the time of the open state of the side entrance.

According to the above-described railcar, the door pocket post includes a vertical bar portion where an end portion, located at the side entrance side, of the outer portion and an end portion, located at the side entrance side, of the inner portion converge, and the projecting portion is provided at the vertical bar portion. Therefore, the satisfactory airtightness can be obtained.

According to the above-described railcar, the rubber seal is attached to the peripheral portion of the side sliding door. Therefore, the ease of maintenance can be improved.

According to the above-described railcar, a step portion is formed at the peripheral portion of the side sliding door, the step portion being depressed inwardly in the car-width direction from a main surface, facing outwardly in the car-width direction, of the side sliding door, and the rubber seal is fixed to the step portion. Therefore, the number of parts can be reduced.

The foregoing has explained the embodiment of the present invention in reference to the drawings. However, the specific configurations of the present invention are not limited to the above embodiment. Design changes and the like may be made within the scope of the present invention.

REFERENCE SIGNS LIST

1 railcar
10 door pocket space
2 side entrance
3 side sliding door
4 rubber seal
6 door pocket post
61 outer portion
62 inner portion
63 coupling portion
64 vertical bar portion
65 projecting portion
7 side entrance peripheral member

The invention claimed is:

1. A railcar comprising:

a side entrance peripheral member including a door pocket post, the side entrance peripheral member surrounding a side entrance of the railcar, the door pocket post having a double skin structure in which an outer portion and an inner portion are coupled to each other by a coupling portion, the inner portion being provided inwardly of the outer portion in a car-width direction of the railcar; and a side sliding door including a peripheral portion that is pressed against an edge portion of the side entrance peripheral member via a rubber seal at a time of a closed state of the side entrance of the railcar, the edge portion of the side entrance peripheral member extending along the side entrance of the railcar, the side sliding door being pulled into a door pocket space adjacent to the inner portion of the door pocket post at a time of an open state of the side entrance of the railcar, wherein the side entrance peripheral member includes a projecting portion projecting inwardly in the car-width direction from the inner portion to beyond the inner portion into the door pocket space in the car-width direction, the projecting portion including a tip end that contacts the rubber seal provided at at least a part of a region constituted by an upper edge and lower edge of the edge portion of the side entrance peripheral member and a lateral edge of the edge portion of the side entrance peripheral member, the lateral edge being located at a door pocket post side.

2. The railcar according to claim 1, wherein a clearance between the side sliding door and the projecting portion before the peripheral portion of the side sliding door is pressed against the edge portion at the time of the closed state of the side entrance is smaller than a clearance between the side sliding door and the inner portion of the door pocket post at the time of the open state of the side entrance.

3. The railcar according to claim 2, wherein:

the door pocket post includes a vertical bar portion located at a convergence of an end portion of the outer portion, which is located at the side entrance side, and an end portion of the inner portion, which is located at the side entrance side; and the projecting portion is provided at the vertical bar portion.

4. The railcar according to claim 3, wherein the rubber seal is attached to the peripheral portion of the side sliding door.

5. The railcar according to claim 4, wherein:

a step portion is formed at the peripheral portion of the side sliding door, the step portion being depressed inwardly in the car-width direction from a main surface of the side sliding door, the main surface facing outwardly in the car-width direction; and the rubber seal is fixed to the step portion.

6. The railcar according to claim 2, wherein the rubber seal is attached to the peripheral portion of the side sliding door.

7. The railcar according to claim 6, wherein:

a step portion is formed at the peripheral portion of the side sliding door, the step portion being depressed inwardly in the car-width direction from a main surface of the side sliding door, the main surface facing outwardly in the car-width direction; and the rubber seal is fixed to the step portion.

8. The railcar according to claim 1, wherein:

the door pocket post includes a vertical bar portion located at a convergence of an end portion of the outer portion, which is located at the side entrance side, and an end portion of the inner portion, which located at the side entrance side; and the projecting portion is provided at the vertical bar portion.

9. The railcar according to claim 8, wherein the rubber seal is attached to the peripheral portion of the side sliding door.

10. The railcar according to claim 9, wherein:

a step portion is formed at the peripheral portion of the side sliding door, the step portion being depressed inwardly in the car-width direction from a main surface of the side sliding door, the main surface facing outwardly in the car-width direction; and the rubber seal is fixed to the step portion.

11. The railcar according to claim 1, wherein the rubber seal is attached to the peripheral portion of the side sliding door.

12. The railcar according to claim 11, wherein:

a step portion is formed at the peripheral portion of the side sliding door, the step portion being depressed inwardly in the car-width direction from a main surface of the side sliding door, the main surface facing outwardly in the car-width direction; and the rubber seal is fixed to the step portion.

* * * * *